US006693383B2

(12) United States Patent
Bae et al.

(10) Patent No.: US 6,693,383 B2
(45) Date of Patent: Feb. 17, 2004

(54) ELECTRO-LUMINESCENCE PANEL

(75) Inventors: Sung Joon Bae, Kyounggi-do (KR); Han Sang Lee, Seoul (KR); Joon Kyu Park, Seoul (KR); Tae Joon Ahn, Seoul (KR)

(73) Assignee: LG.Philips LCD Co., Ltd., Seoul (KR)

( * ) Notice: Subject to any disclaimer, the term of this patent is extended or adjusted under 35 U.S.C. 154(b) by 13 days.

(21) Appl. No.: 10/024,284

(22) Filed: Dec. 21, 2001

(65) Prior Publication Data

US 2002/0101177 A1 Aug. 1, 2002

(30) Foreign Application Priority Data

Dec. 23, 2000 (KR) ..... 2000-0081417

(51) Int. Cl.[7] ..... G09G 3/10

(52) U.S. Cl. ..... 315/169.1; 315/169.2; 315/169.3; 345/204; 345/214

(58) Field of Search ..... 315/169.3, 169.1, 315/169.2; 345/76–78, 45, 46, 92, 204–206, 214, 690, 698; 349/42, 43, 45

(56) References Cited

U.S. PATENT DOCUMENTS

| | | | | | |
|---|---|---|---|---|---|
| 4,975,691 | A | * | 12/1990 | Lee | 345/79 |
| 6,023,259 | A | * | 2/2000 | Howard et al. | 345/76 |
| 6,091,203 | A | | 7/2000 | Kawashima et al. | |
| 6,140,980 | A | * | 10/2000 | Spitzer et al. | 345/8 |
| 6,246,180 | B1 | * | 6/2001 | Nishigaki | 315/169.3 |
| 6,356,029 | B1 | * | 3/2002 | Hunter | 315/169.1 |
| 6,359,605 | B1 | * | 3/2002 | Knapp et al. | 345/76 |

* cited by examiner

*Primary Examiner*—Haissa Philogene
(74) *Attorney, Agent, or Firm*—McKenna Long & Aldridge LLP

(57) ABSTRACT

An electro-luminescence panel that is capable of improving brightness. In the panel, a single of compensation circuit is configured for a single of gate lines. Accordingly, the panel can considerably improve an aperture ratio in comparison to the existent electro-luminescence panel adopting a compensation circuit for each pixel. Also, it can improve a throughput and eliminate a stripe occurring at the pixel cell.

42 Claims, 6 Drawing Sheets

ELECTRO-LUMINESCENCE PANEL

This application claims the benefit of Korean Patent Application No. 2000-81417, filed on Dec. 23, 2000, the entirety of which is hereby incorporated by reference for all purposes as if fully set forth herein.

BACKGROUND OF THE INVENTION

1. Field of the Invention

This invention relates to an electro-luminescence display (ELD), and more particularly to an electro-luminescence panel that is capable of improving brightness.

2. Description of the Related Art

Recently, various flat panel display devices have been developed with reduced weight and bulk that are capable of eliminating the disadvantages associated with a cathode ray tube (CRT). Such flat panel display devices include liquid crystal displays (LCD), field emission displays (FED), plasma display panels (PDP) and electro-luminescence (EL) panels.

Studies have been made increasing the display quality of the flat panel display device and for providing the flat panel display with a large-scale screen. The EL panel in such display devices is a self-emission device. The EL panel excites a fluorescent material using carriers such as electrons and holes, to display a video image. The EL panel has advantages in that a low direct current driving voltage is possible and the response speed is fast.

Referring to FIG. 1, the conventional EL panel includes gate line pairs GL and /GL and data lines DL arranged on a glass substrate 10 in such a manner to cross each other, and pixel elements PE arranged at each crossing of the gate line pairs GL and /GL and the data lines DL. Each pixel element PE is driven when gate signals at the gate line pairs GL and /GL are enabled, to thereby generate light corresponding to the magnitude of pixel signals at the data lines DL.

In order to drive such pixel elements PE, a gate driver 12 is connected to the gate line pairs GL and /GL while a data driver 14 is connected to the data lines DL. The gate driver 12 drives the gate line pairs GL and /GL sequentially. The data driver 14 applies pixel signals to the pixels PE via the data lines DL.

Each of the pixel elements PE driven with the gate driver 12 and the data driver 14 in this manner includes an EL cell, that is, an organic light emitting diode OLED connected to a ground voltage line GND, and a cell driving circuit 16 for driving the EL cell OLED. The EL cell OLED emits light corresponding to an amount of current applied from the cell driving circuit 16.

Referring to FIG. 2, the cell driving circuit 16 includes a first PMOS thin film transistor (TFT) MP1 connected between first and second nodes N1 and N2, and the EL cell OLED, a second PMOS TFT MP2 connected between the second node N2 and the EL cell OLED, and a capacitor C1 connected between the first and second nodes N1 and N2.

The capacitor C1 charges a voltage of a pixel signal when the pixel signal is received from the data line DL and applies the charged pixel voltage to the gate electrode of the first PMOS TFT MP1. The first PMOS TFT MP1 is turned on by the pixel voltage charged in the first capacitor C1, to thereby apply a supply voltage VDD from a voltage supply line VDDL, via the first node N1, to the EL cell OLED. At this time, a channel width of the first PMOS TFT MP1 is varied depending on the voltage level of the pixel signal to control an amount of current applied to the EL cell OLED.

Accordingly, the EL cell OLED generates light corresponding to the current amount applied from the first PMOS TFT MP1.

The second PMOS TFT MP2 responds to a gate signal GLS, as shown in FIG. 3, applied from the gate line GL to selectively connect the second node N2 to the EL cell OLED. More specifically, the second PMOS TFT MP2 connects the second node N2 to the EL cell OLED at a time interval when the gate signal GLS is enabled at a low logic, to thereby charge the pixel signal into the capacitor C1. In other words, the second PMOS TFT MP2 forms a current path of the first capacitor C1 at a time interval when the gate signal GLS at the gate line GL is enabled.

The capacitor C1 charges a pixel signal at the enabling interval of the gate signal GLS and allows a voltage at the gate electrode of the first PMOS TFT MP1 to go lower than a voltage at the drain electrode thereof by the voltage level of the charged pixel signal. Thus, the first PMOS TFT MP1 controls its channel width depending on the voltage level of the pixel signal, to thereby determine the current amount flowing from the first node N1 into the EL cell OLED.

The cell driving circuit 16 in FIG. 2 further includes a third PMOS TFT MP3 responding to a gate signal GLS at the gate line GL, and a fourth PMOS TFT MP4 responding to an inverted gate signal /GLS from the gate bar line /GL.

The third PMOS TFT MP3 is turned on at a time interval when a low logic of the gate signal GLS is applied from the gate line GL, to thereby connect the capacitor C1 connected to the first node N1 and the drain electrode of the first PMOS TFT MP1 to the data line DL. In other words, the third PMOS TFT MP3 plays the role of sending a pixel signal at the data line DL to the first node N1 in response to a low logic of gate signal GLS. As a result the third PMOS TFT MP3 is turned on at a time interval when the gate signal GLS at the gate line GL remains at a low logic, to thereby charge the pixel signal into the capacitor C1 connected between the first and second nodes N1 and N2.

The fourth PMOS TFT MP4 is turned on at a time interval when a low logic of the inverted gate signal /GLS from the gate inverting line /GL is applied to the gate electrode thereof, to thereby connect the first node N1 to which the capacitor C1 and the drain electrode of the first PMOS TFT MP1 have been connected, to the voltage supply line VDDL. At a time interval when the fourth PMOS TFT MP4 has been turned on, a supply voltage VDD at the voltage supply line VDDL is applied to the EL cell OLED, via the first node N1 and the first PMOS TFT MP1. Thus, the EL cell OLED generates light corresponding to an amount of the voltage level of the pixel signal.

The EL panel as mentioned above receives the current required for generating light using the EL cell OLED from the PMOS TFT. Such a characteristic of the PMOS TFT is as shown in FIG. 4.

Referring to FIG. 4, the characteristic of the PMOS TFT shows that a voltage VDS between the drain electrode and the source electrode and a drain current ID differs depending on a value of a gate voltage VG applied to the gate electrode. Particularly, in the EL panel, a control of the current is most important because light emission amount varies depending on an amount of the current.

A current applied to the EL cell OLED increases until it reaches a threshold voltage VTH of the PMOS TFT like portion 'A' indicated by the dotted lines in FIG. 4, with respect to a small variation of the voltage VDS between the drain electrode and the source electrode. As a result, there is a problem in that vertical and horizontal stripes occur at a video image displayed on the EL panel.

SUMMARY OF THE INVENTION

Accordingly, the present invention is directed to an electro-luminescence panel that substantially obviates one or more of the problems due to limitations and disadvantages of the related art.

An advantage of the present invention is to provide an electro-luminescence panel that is capable of improving brightness.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages of the invention, an electro-luminescence panel according to one embodiment of the present invention includes a first electro-luminescence cell driving circuit arranged at a crossing of a first gate line and a data line to drive electro-luminescence cells; and a second electro-luminescence cell driving circuit arranged at each crossing of the gate lines other than the first gate line and the data lines to drive the electro-luminescence cells.

In the electro-luminescence panel, the first electro-luminescence cell driving circuit includes a power supply for supplying power to the electro-luminescence cells; a first PMOS thin film transistor connected between the power supply and the data line; a second PMOS thin film transistor connected between the power supply and the electro-luminescence cell; a third PMOS thin film transistor connected between the gate electrodes of the first and second PMOS thin film transistors to serve as a switch; and a capacitor connected between the gate electrode of the second PMOS thin film transistor and the power supply.

Current flowing at the second PMOS thin film transistor is controlled by a ratio of width (a portion in which a semiconductor layer overlaps with the gate line) to length (a distance between the source and the drain) of each of the first PMOS thin film transistor and the second PMOS thin film transistor.

In the electro-luminescence panel, the second electro-luminescence cell driving circuit includes a power supply for supplying power to the electro-luminescence cells; a fourth PMOS thin film transistor connected between the power supply and the electro-luminescence cell; a fifth PMOS thin film transistor connected between the data line and the gate electrodes of the fourth PMOS thin film transistor to serve as a switch; and a capacitor connected between the gate electrode of the fourth PMOS thin film transistor and the power supply.

A current flowing at the fourth PMOS thin film transistor is controlled by a ratio of width (a portion in which a semiconductor layer overlaps with the gate line) to length (a distance between the source and the drain) of each of the first PMOS thin film transistor and the fourth PMOS thin film transistor.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENT

Reference will now be made in detail to an embodiment of the present invention, example of which is illustrated in the accompanying drawings.

Figure 1:
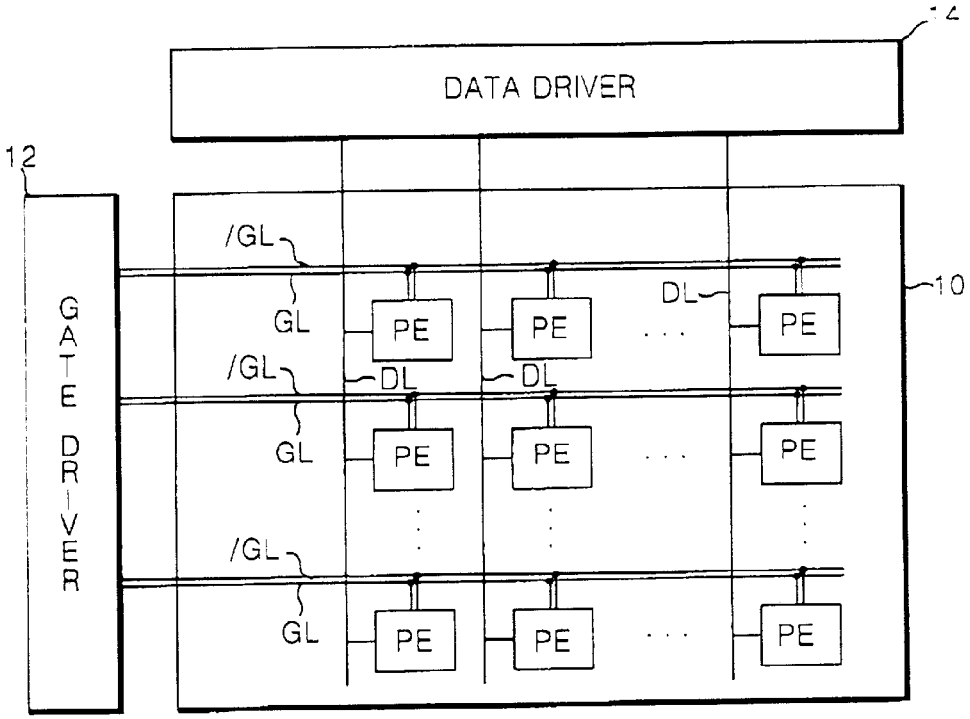
FIG. 1 CONVENTIONAL ART
FIG. 1 is a schematic block circuit diagram showing a configuration of a conventional electro-luminescence panel.
Figure 2:
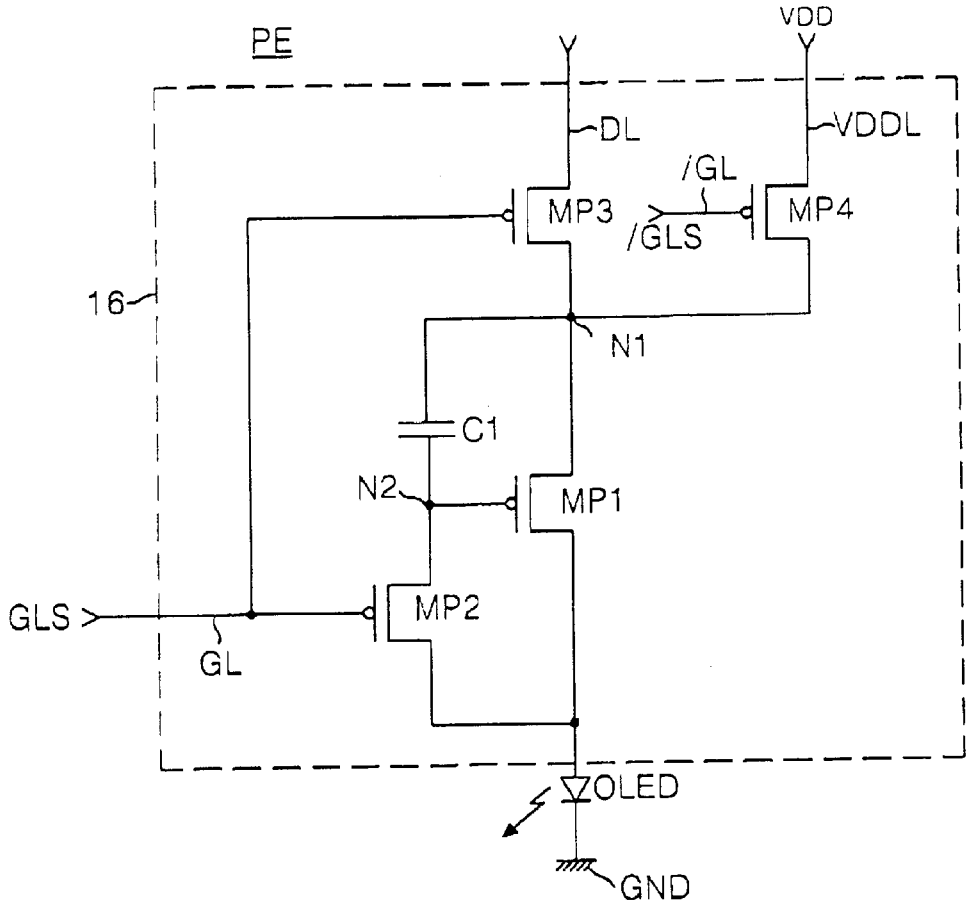
FIG. 2 CONVENTIONAL ART
FIG. 2 is a detailed circuit diagram of the pixel element shown in FIG. 1.
Figure 3:
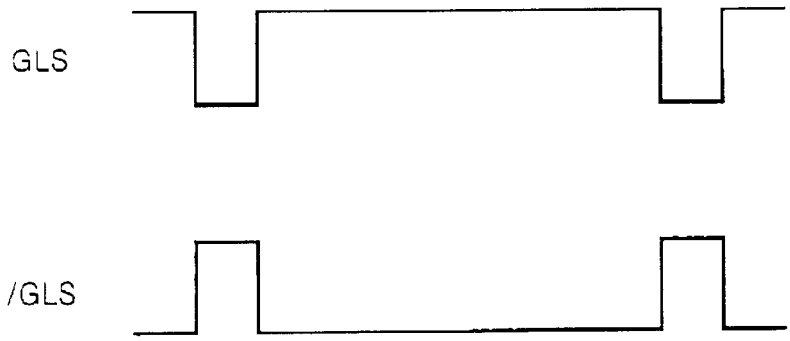
FIG.3 CONVENTIONAL ART
FIG. 3 is a waveform diagram of a gate signal to be applied to the pixel element shown in FIG. 1.
Figure 4:
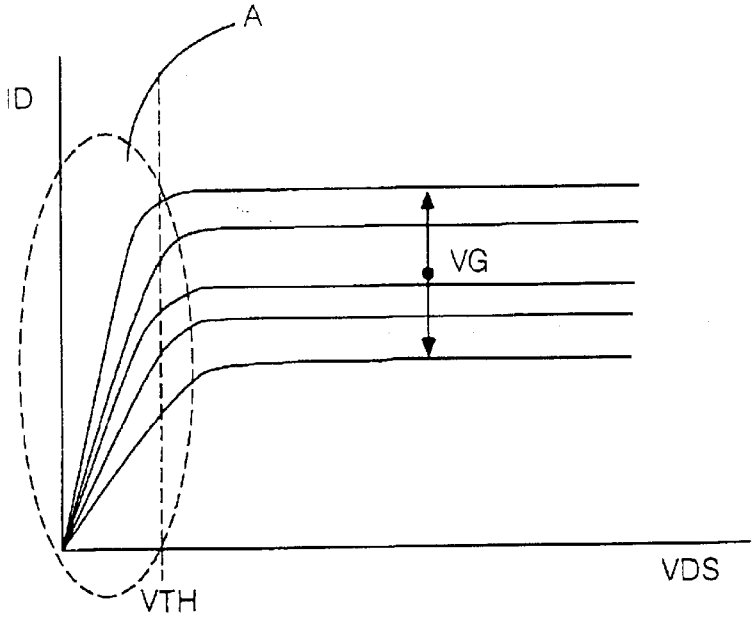
FIG.4 CONVENTIONAL ART
FIG. 4 is a graph representing a characteristic of a thin film transistor.
Figure 5:
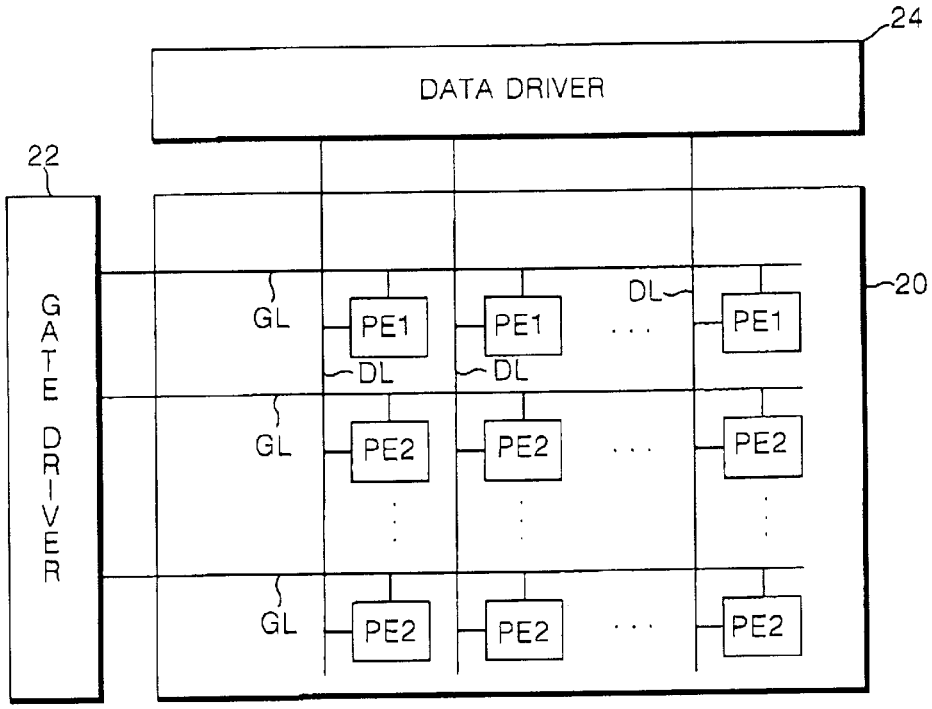
FIG. 5 is a schematic block circuit diagram showing a configuration of an electro-luminescence panel according to an embodiment of the present invention.

Referring to FIG. 5, there is shown an electro-luminescence (EL) panel according to an embodiment of the present invention.

The EL panel includes gate lines GL and data lines DL arranged on a glass substrate 20 in such a manner to cross each other, first and second pixel elements PE1 and PE2 arranged at each crossing of the gate lines GL and the data lines DL. Each of the first and second pixel elements PE1 and PE2 is driven when gate signals at the gate lines GL are enabled, to thereby generates light corresponding to the magnitude of pixel signals at the data lines DL.

In order to drive such pixel elements PE1 and PE2, a gate driver 22 is connected to the gate lines GL while a data driver 24 is connected to the data lines DL. The gate driver 22 drives the gate lines GL sequentially. The data driver 24 applies pixel signals to the first and second pixel elements PE1 and PE2 via the data lines DL.

Figure 6:
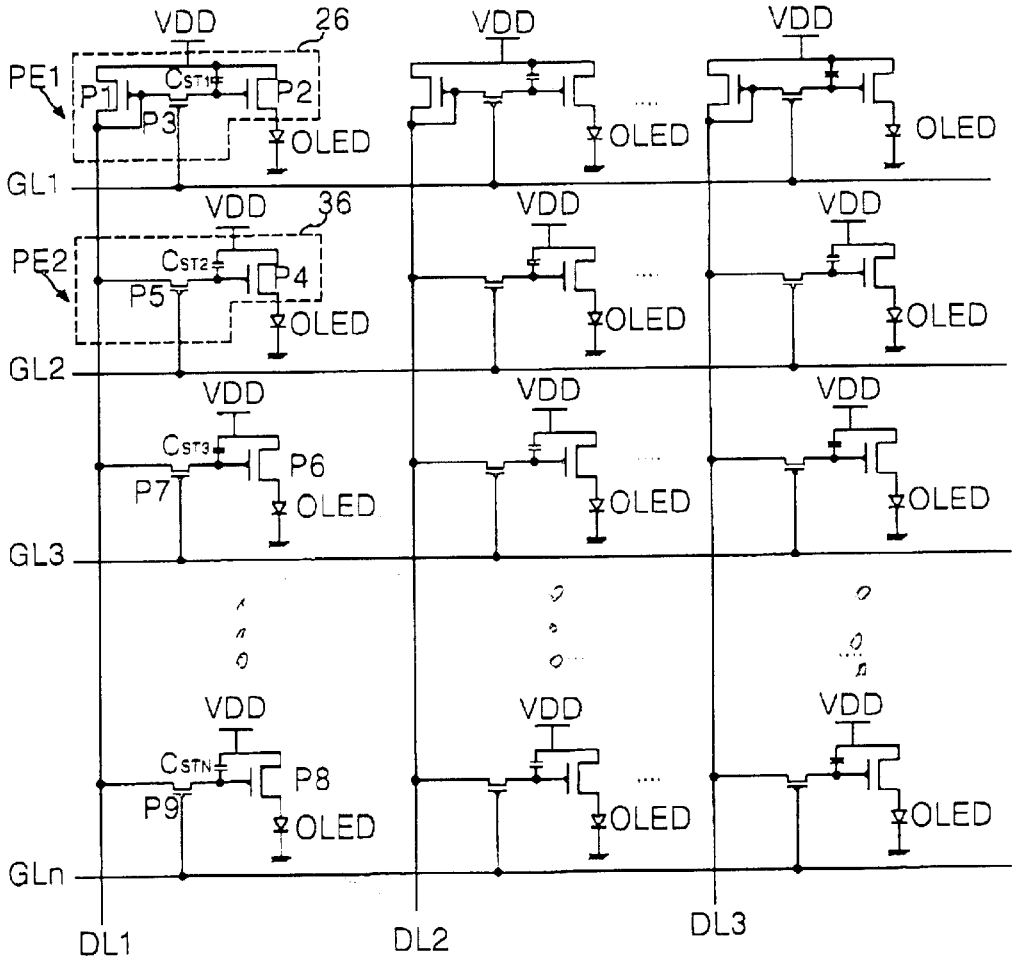
FIG. 6 is a detailed circuit diagram of the pixel element shown in FIG. 5.

Each of the first and second pixel elements PE1 and PE2 driven with the gate driver 22 and the data driver 24 in this manner includes a first EL cell driving circuit PE1 arranged at a crossing of the first gate line GL and the data line DL to drive the EL panel, and a second EL cell driving circuit PE2 arranged at each crossing of the gate lines GL2 to GLn, shown in FIG. 6, other than the first gate line GL1 and the data lines DL to drive the EL panel.

The first EL cell driving circuit PE1 applies a forward current signal, varying a backward current amount at the data line DL to the EL cell OLED at a time interval when a gate signal at the gate line GL is enabled. To this end, as shown in FIG. 6, the first EL cell driving circuit PE1 consists of an EL cell, that is, an organic light emitting diode OLED connected to a ground voltage line GND, and a compensation circuit 26 having three thin film transistors (TFTs) arranged at each crossing of the first gate line GL1 and the data lines DL. The EL cell OLED emits light corresponding to an amount of current applied from the compensation circuit 26.

The compensation circuit 26 includes first and second PMOS TFTs P1 and P2 connected to form a current mirror at the voltage supply line VDD, a third PMOS TFT P3 connected between the gate electrodes of the first and second PMOS TFTs P1 and P2 to serve as a switch, and a capacitor CST1 connected between the second PMOS TFT P2 and the voltage supply line VDD.

Figure 7:
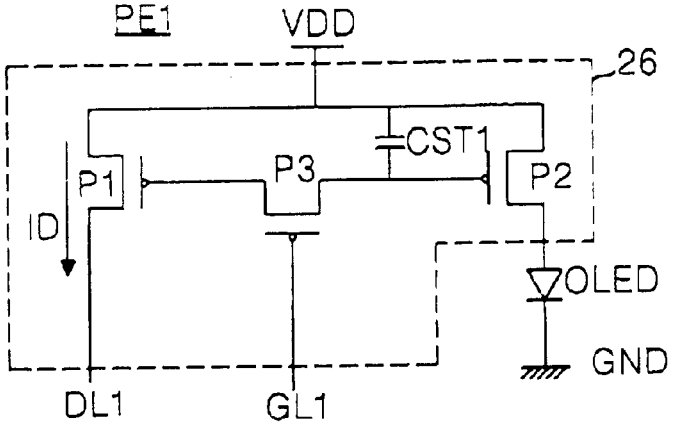
FIG. 7 is a circuit diagram of the first EL cell driving circuit PE1 shown in FIG. 6.

The capacitor CST1 charges a current signal at the data line DL when the voltage supply line VDD is connected to the data line DL and applies the charged current signal to the gate electrode of the second PMOS TFT P2. The second PMOS TFT P2 is turned on by the current signal having been charged in the capacitor CST1 to apply a supply voltage VDD at the voltage supply line VDD to the EL cell OLED. The third PMOS TFT P3 plays a role to switch the first and second PMOS TFTs P1 and P2. When the third PMOS TFT P3 is turned on, the first and second PMOS TFTs P1 and P2 become a current mirror. Thus, as shown in FIG. 7, when the first PMOS TFT P1 is turned on, a current ID with a constant magnitude flows at the first data line DL1 via the first PMOS TFT P1 and current being equal to an amount of the current ID flowing at the first data line DL1 is applied to the EL cell OLED via the second PMOS TFT P2.

At this time, the current applied to the EL cell OLED is fed during a holding time resulting from the capacitor CST1. The current flowing at the first data line DL1 and the current applied to the EL cell OLED are determined by a ratio of a width to a length of each of the first PMOS TFT P1 and the second PMOS TFT P2. In other words, if a ratio of a width to a length of the first PMOS TFT P1 is equal to that of the second PMOS TFT P2, then the same magnitude of current ID flows at the first data line DL1 and the EL cell OLED. On the other hand, if a ratio of a width to a length between the first PMOS TFT P1 and the second PMOS TFT T2 is 1: K, then current flowing at the second PMOS TFT P2 is larger, by a magnitude of K×current ID, than current flowing at the first PMOS TFT P1.

Accordingly, the first PMOS TFT P1 and the second PMOS TFT P2 can control current flowing at the second PMOS TFT P2 without being influenced by a threshold voltage VTH. In other words, the current amount applied to the EL cell OLED can be controlled irrespective of the threshold voltage VTH.

Figure 8:
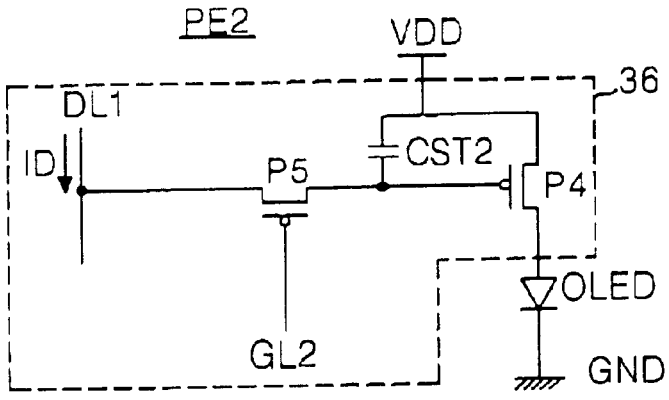
FIG. 8 is a circuit diagram of the second EL cell driving circuit PE2 shown in FIG. 6.

As shown in FIG. 8, the second EL cell driving circuit PE2 consists of an EL cell OLED connected to a ground voltage line GND, and a cell driving circuit 36 having two thin film transistors P4 and P5 arranged at each crossing of the gate lines GL2 to GLn (not shown) other than the first gate line GL1 and the data lines DL. The EL cell OLED emits light corresponding to an amount of current applied from the cell driving circuit 36.

The cell driving circuit 36 applies a forward current signal which varies depending on the amount of backward current at the data line DL when a gate signal at the gate line GL is enabled to the EL cell OLED. To this end, the cell driving circuit 36 includes a fourth PMOS TFT P4 connected between the EL cell OLED and the voltage supply line VDD, a fifth PMOS TFT PS connected between the gate electrode of the fourth PMOS TFT P4 and the data lines DL to serve as a switch, and a capacitor CST2 connected between the gate electrode of the fourth PMOS TFT P4 and the voltage supply line VDD.

The capacitor CST2 charges a current signal at the data line DL when the voltage supply line VDD is connected to the data line DL and applies the charged current signal to the gate electrode of the fourth PMOS TFT P4. The fourth PMOS TFT P4 is turned on by the current signal having been charged in the capacitor CST2 to apply a supply voltage VDD at the voltage supply line VDD to the EL cell OLED. The fifth PMOS TFT P5 plays the role of switching the fourth PMOS TFT P4. When the fifth PMOS TFT P5 is turned on, the fourth PMOS TFT P4 forms a current mirror along with the first PMOS TFT P1 of the above-mentioned first EL cell driving circuit PE1. Thus, the first PMOS TFT P1 is turned on to allow a current ID with a constant magnitude to flow at the first data line DL via the first PMOS TFT P1, so that the current being equal to an amount of the current ID flowing at the first data line DL1 is applied to the EL cell OLED via the fourth PMOS TFT P4.

At this time, the current applied to the EL cell OLED is fed during a holding time resulting from the capacitor CST2. The current flowing at the first data line DL1 and the current applied to the EL cell OLED are determined by a ratio of a width to a length of each of the first PMOS TFT P1 and the fourth PMOS TFT P4. In other words, if a ratio of a width to a length of the first PMOS TFT P1 is equal to that of the fourth PMOS TFT P4, then the same magnitude of current ID flows at the first data line DL1 and the EL cell OLED. On the other hand, if a ratio of a width to a length between the first PMOS TFT P1 and the fourth PMOS TFT T4 is 1: K, then the current flowing at the fourth PMOS TFT P4 is larger, by a magnitude of the K×current ID, than the current flowing at the first PMOS TFT P1.

Accordingly, the first PMOS TFT P1 and the fourth PMOS TFT P4 can control current flowing at the fourth PMOS TFT P4 without being influenced by a threshold voltage VTH. In other words, the current amount applied to the EL cell OLED can be controlled irrespective of the threshold voltage VTH.

As described above, the first PMOS TFT P1 and the second PMOS TFT P2, taking a shape of a current mirror are provided at a crossing of the first gate line GL and the data line DL, so that the current amount applied to the EL cell OLED is not influenced by a threshold voltage of the TFT. Further, the fourth PMOS TFT P4 forming a current mirror along with the first PMOS TFT P1 is provided at the second to nth gate lines, GL2 to GLn other than the first gate line, so that the current being equal to the current flowing at the data line DL via the first PMOS TFT P1 is applied to the EL cell OLED via the fourth PMOS TFT P4.

Accordingly, it becomes possible to control an amount of current applied to the EL cell OELD by differentiating a ratio of width to length of each of the first and second PMOS TFTs P1 and P2 and the first and fourth PMOS TFTs P1 and P4.

As described above, the electro-luminescence panel according to the present invention has advantages in that it can considerably improve an aperture ratio in comparison to the electro-luminescence panel which adopts a compensation circuit for each pixel by configuring a single compensation circuit for a single gate line. Also, it can improve a throughput and eliminate a stripe occurring at the pixel cell. Moreover, the electro-luminescence panel according to the present invention has reduced the number of TFTs from the conventional four-TFT structure into a two-TFT structure, thereby largely improving an aperture ratio.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. An electro-luminescence panel including gate lines, data lines arranged in such a manner to cross the gate lines, and electro-luminescence cells provided at each crossing of the gate lines and the data lines, the panel comprising:

a first electro-luminescence cell driving circuit arranged at a crossing of the first gate line and the data line to drive the electro-luminescence cells; and a second electro-luminescence cell driving circuit arranged at each crossing of the gate lines other than the first gate line and the data lines to drive the electro-luminescence cells, wherein the first electro-luminescence cell driving circuit includes a power supply for supplying power to the electro-luminescence cells, a first PMOS thin film transistor connected between the power supply and the data line, a second PMOS thin film transistor connected between the power supply and the electro-luminescence cell, a third PMOS thin film transistor connected between the gate electrodes of the first and second PMOS thin film transistors to serve as a switch and a capacitor connected between the gate electrode of the second PMOS thin film transistor and the power supply.

2. The electro-luminescence panel according to claim 1, wherein current flowing at the second PMOS thin film transistor is controlled by a ratio of width to length of each of the first PMOS transistor and the second PMOS thin film transistor.

3. An electro-luminescence panel, comprising:

a first electro-luminescence cell driving circuit arranged at a crossing of a first gate line and a data line to drive electro-luminescence cells; and a second electro-luminescence cell driving circuit arranged at each crossing of the gate lines other than the first gate line and the data lines to drive the electro-luminescence cells, wherein the second electro-luminescence cell driving circuit includes a power supply for supplying power to the electro-luminescence cells, a fourth PMOS thin film transistor connected between the power supply and the electro-luminescence cell, a fifth PMOS thin film transistor connected between the data line and the gate electrode of the fourth PMOS thin film transistor to serve as a switch and a capacitor connected between the gate electrode of the fourth PMOS thin film transistor and the power supply.

4. An electro-luminescence panel including gate lines, data lines arranged in such a manner to cross the gate lines, and electro-luminescence cells provided at each crossing of the gate lines and the data lines, the panel comprising:

a first electro-luminescence cell driving circuit arranged at a crossing of the first gate line and the data line to drive the electro-luminescence cells; and a second electro-luminescence cell driving circuit arranged at each crossing of the gate lines other than the first gate line and the data lines to drive the electro-luminescence cells, wherein the second electro-luminescence cell driving circuit includes a power supply for supplying power to the electro-luminescence cells, a fourth PMOS thin film transistor connected between the power supply and the electro-luminescence cell, a fifth PMOS thin film transistor connected between the data line and the gate electrode of the fourth PMOS thin film transistor to serve as a switch and a capacitor connected between the gate electrode of the fourth PMOS thin film transistor and the power supply.

5. The electro-luminescence panel according to claim 4, wherein current flowing at the fourth PMOS thin film transistor is controlled by a ratio of width to length of each of the first PMOS transistor and the fourth PMOS thin film transistor.

6. An electro-luminescence panel comprising:

a first electro-luminescence cell driving circuit arranged at a crossing of a first gate line and a data line to drive electro-luminescence cells; and a second electro-luminescence cell driving circuit arranged at each crossing of the gate lines other than the first gate line and the data lines to drive the electro-luminescence cells, wherein the first electro-luminescence cell driving circuit includes a power supply for supplying power to the electro-luminescence cells, a first PMOS thin film transistor connected between the power supply and the data line, a second PMOS thin film transistor connected between the power supply and the electro-luminescence cell, a third PMOS thin film transistor connected between the gate electrodes of the first and second PMOS thin film transistors to serve as a switch and a capacitor connected between the gate electrode of the second PMOS thin film transistor and the power supply.

7. A method of manufacturing an electro-luminescence panel including gate lines, data lines arranged in such a manner to cross the gate lines, and electro-luminescence cells provided at each crossing of the gate lines and the data lines, the method comprising:

forming a first electro-luminescence cell driving circuit arranged at a crossing of the first gate line and the data line to drive the electro-luminescence cells; and forming a second electro-luminescence cell driving circuit arranged at each crossing of the gate lines other than the first gate line and the data lines to drive the electro-luminescence cells, wherein forming the first electro-luminescence cell driving circuit includes forming a power supply for supplying power to the electro-luminescence cells, forming a first PMOS thin film transistor connected between the power supply and the data line, forming a second PMOS thin film transistor connected between the power supply and the electro-luminescence cell, forming a third PMOS thin film transistor connected between the gate electrodes of the first and second PMOS thin film transistors to serve as a switch and forming a capacitor connected between the gate electrode of the second PMOS thin film transistor and the power supply.

8. The method according to claim 7, wherein current flowing at the second PMOS thin film transistor is controlled by a ratio of width to length of each of the first PMOS transistor and the second PMOS thin film transistor.

9. An electro-luminescence panel comprising:

gate lines and data lines arranged on a glass substrate to cross each other; and first and second pixel elements and arranged at each crossing of the gate lines and the data lines, wherein each of the first and second pixel elements is driven when gate signals at the gate lines are enabled, to thereby generate light corresponding to the magnitudes of pixel signals at the data lines, wherein a gate driver is connected to the gate lines while a data driver is connected to the data lines, the gate driver for driving the gate lines sequentially and the data driver for applying pixel signals to the first and second pixel elements via the data lines, and wherein each of the first and second pixel elements driven with the gate driver and the data driver includes a first electro-luminescence cell driving circuit arranged at a crossing of a first gate line and a data line to drive the electro-luminescence panel and a second electro-luminescence cell driving circuit arranged at each crossing of the gate lines other than the first gate line and the data line to drive the electro-luminescence panel, and wherein the first electro-luminescence cell driving circuit includes an organic light emitting diode connected to a ground voltage line and a compensation circuit having at least three thin film transistors arranged at each crossing of the first gate line and the data lines.

10. The electro-luminescence panel of claim 9, wherein the first electro-luminescence cell driving circuit applies a forward current signal varying a backward current amount at the data line to the organic light emitting diode in a time interval when a gate signal at the gate line is enabled.

11. The electro-luminescence panel of claim 9, wherein the organic light emitting diode emits light corresponding to an amount of current applied from the compensation circuit.

12. The electro-luminescence panel of claim 11, wherein the compensation circuit includes:

first and second PMOS thin film transistors connected to form a current mirror at a voltage supply line;

a third PMOS thin film transistor connected between the gate electrodes of the first and second PMOS thin film transistors, and a first capacitor connected between the second PMOS thin film transistor and the voltage supply line.

13. The electro-luminescence panel of claim 12, wherein the third PMOS thin film transistor serves as a switch for the first and second PMOS thin film transistors.

14. The electro-luminescence panel of claim 13, wherein when the third PMOS thin film transistor is turned on, the first and second PMOS thin film transistors become a current mirror, wherein a current with a constant magnitude flows at the first data line through the first PMOS thin film transistor and a current being equal to an amount of the current flowing at the first data line is applied to the organic light emitting diode through the second PMOS thin film transistor.

15. The electro-luminescence panel of claim 14, wherein the current applied to the organic light emitting diode is fed during a holding time resulting from the first capacitor.

16. The electro-luminescence panel of claim 14, wherein the current flowing at the first data line and the current applied to the organic light emitting diode are determined by a ratio of width to length of each of the first PMOS thin film transistor and the second PMOS thin film transistor.

17. The electro-luminescence panel of claim 14, wherein the first PMOS thin film transistor and the second PMOS thin film transistor control current flowing at the second PMOS thin film transistor without being influenced by a threshold voltage.

18. The electro-luminescence panel of claim 12, wherein the first capacitor charges a current signal at the data line when the voltage supply line is connected to the data line and applies the charged current signal to the gate electrode of the second PMOS thin film transistor.

19. The electro-luminescence panel of claim 12, wherein the second PMOS thin film transistor is turned on by the current signal having been charged in the first capacitor to apply a supply voltage at the voltage supply line to the organic light emitting diode.

20. An electro-luminescence panel, comprising:

gate lines and data lines arranged on a glass substrate to cross each other;

first and second pixel elements and arranged at each crossing of the gate lines and the data lines, wherein each of the first and second pixel elements is driven when gate signals at the gate lines are enabled, to thereby generate light corresponding to the magnitudes of pixel signals at the data lines, wherein a gate driver is connected to the gate lines while a data driver is connected to the data lines, the gate driver for driving the gate lines sequentially and the data driver for applying pixel signals to the first and second pixel elements via the data lines, and wherein each of the first and second pixel elements driven with the gate driver and the data driver includes a first electro-luminescence cell driving circuit arranged at a crossing of a first gate line and a data line to drive the electro-luminescence panel and a second electro-luminescence cell driving circuit arranged at each crossing of the gate lines other than the first gate line and the data line to drive the electro-luminescence panel, and wherein the second electro-luminescence cell driving circuit includes an electro-luminescence cell organic light emitting diode connected to a ground voltage line and a cell driving circuit having two thin film transistors arranged at each crossing of the gate lines other than the first gate line and the data lines, the organic light emitting diode emits light corresponding to an amount of current applied from the cell driving circuit.

21. The electro-luminescence panel of claim 20, wherein the cell driving circuit applies a forward current signal varying depending on a backward current amount at the data line when a gate signal at the gate line is enabled to the organic light emitting diode.

22. The electro-luminescence panel of claim 21, the current flowing at the first data line and the current applied to the organic light emitting diode are determined by a ratio of width to length of each of the first PMOS thin film transistor and the fourth PMOS thin film transistor.

23. The electro-luminescence panel of claim 22, wherein the first PMOS thin film transistor and the fourth PMOS thin film transistor control current flowing at the fourth PMOS thin film transistor without being influenced by a threshold voltage.

24. The electro-luminescence panel of claim 20, wherein the cell driving circuit includes:

a fourth PMOS thin film transistor connected between the organic light emitting diode and the voltage supply line;

a fifth PMOS thin film transistor connected between the gate electrode of the fourth PMOS thin film transistor and the data lines to serve as a switch; and a second capacitor connected between the gate electrode of the fourth PMOS thin film transistor and the voltage supply line.

25. The electro-luminescence panel of claim 24, wherein the second capacitor charges a current signal at the data line when the voltage supply line is connected to the data line and applies the charged current signal to the gate electrode of the fourth PMOS thin film transistor.

26. The electro-luminescence panel of claim 25, wherein the fourth PMOS thin film transistor is turned on by the current signal having been charged in the second capacitor to apply a supply voltage at the voltage supply line to the organic light emitting diode.

27. The electro-luminescence panel of claim 24, wherein the fifth PMOS thin film transistor serves as a switch for the fourth PMOS thin film transistor.

28. The electro-luminescence panel of claim 27, wherein when the fifth PMOS thin film transistor is turned on, the fourth PMOS thin film transistor forms a current mirror along with the first PMOS thin film transistor of the first electro-luminescence cell driving circuit.

29. The electro-luminescence panel of claim 28, wherein the first PMOS thin film transistor is turned on to allow current with a constant magnitude to flow at the first data line through the first PMOS thin film transistor, so that a current being equal to an amount of the current flowing at the first data line is applied to the organic light emitting diode through the fourth PMOS thin film transistor.

30. The electro-luminescence panel of claim 29, wherein the current applied to the organic light emitting diode is fed during a holding time resulting from the second capacitor.

31. A method of manufacturing an electro-luminescence panel including gate lines, data lines arranged in such a manner to cross the gate lines, and electro-luminescence cells provided at each crossing of the gate lines and the data lines, the method comprising:

forming a first electro-luminescence cell driving circuit arranged at a crossing of the first gate line and the data line to drive the electro-luminescence cells; and forming a second electro-luminescence cell driving circuit arranged at each crossing of the gate lines other than the first gate line and the data lines to drive the electro-luminescence cells, wherein forming the second electro-luminescence cell driving circuit includes forming a power supply for supplying power to the electro-luminescence cells, forming a fourth PMOS thin film transistor connected between the power supply and the electro-luminescence cell, forming a fifth PMOS thin film transistor connected between the data line and the gate electrode of the fourth PMOS thin film transistor to serve as a switch and forming a capacitor connected between the gate electrode of the fourth PMOS thin film transistor and the power supply.

32. The method according to claim 31, wherein current flowing at the fourth PMOS thin film transistor is controlled by a ratio of width to length of each of the first PMOS transistor and the fourth PMOS thin film transistor.

33. An electro-luminescence panel, comprising:

a first electro-luminescence cell driving circuit arranged at a crossing of a first gate line and a first data line to drive the first electro-luminescence cell; and a second electro-luminescence cell driving circuit arranged at a crossing of a second gate line and a second data line to drive the second electro-luminescence cell, wherein the first electro-luminescence cell driving circuit includes a compensation circuit utilizing a current mirror.

34. An electro-luminescence panel according to claim 33, wherein the first data line and the second data line are the same data line.

35. An electro-luminescence panel according to claim 33, wherein the first gate line is a gate line at an outermost edge of the panel.

36. An electro-luminescence panel according to claim 33, wherein the first electro-luminescence cell driving circuit includes first, second and third thin film transistors and the second electro-luminescence cell driving circuit includes first and second thin film transistors.

37. An electro-luminescence panel comprising:

a first electro-luminescence cell driving circuit arranged at a crossing of a first gate line and a first data line to drive a first electro-luminescence cell; and a second electro-luminescence cell driving circuit arranged at a crossing of a second gate line and a second data line to drive a second electro-luminescence cell, wherein the second electro-luminescence cell driving circuit is coupled to the first electro-luminescence cell driving circuit to drive the second electro-luminescence cell.

38. An electro-luminescence panel according to claim 37, further comprising N electro-luminescence cell driving circuits coupled to the first electro-luminescence cell driving circuit to drive N electro-luminescence cells, wherein N is an integer of 1 or higher.

39. An electro-luminescence panel comprising:

a first electro-luminescence cell driving circuit arranged at a crossing of a first gate line and a first data line to drive a first electro-luminescence cell; and a second electro-luminescence cell driving circuit arranged at a crossing of a second gate line and a second data line to drive a second electro-luminescence cell, wherein the first electro-luminescence cell driving circuit includes a first thin film transistor and the second electro-luminescence cell driving circuit includes a second thin film transistor, and wherein the first thin film transistor forms a current mirror along with the second thin film transistor during an operation of the second electro-luminescence cell.

40. An electro-luminescence panel according to claim 39, wherein the first data line and the second data line are the same data line.

41. An electro-luminescence panel according to claim 39, wherein the first gate line is a gate line at an outermost edge of the panel.

42. An electro-luminescence panel according to claim 39, wherein the first electro-luminescence cell driving circuit includes three thin film transistors and the second electro-luminescence cell driving circuit includes two thin film transistors.

* * * * *